United States Patent [19]

Arai

[11] Patent Number: 4,540,999

[45] Date of Patent: Sep. 10, 1985

[54] HEAT-SENSITIVE RECORD MATERIAL

[75] Inventor: Naoto Arai, Ikeda, Japan

[73] Assignee: Kanzaki Paper Manufacturing Co., Ltd., Japan

[21] Appl. No.: 629,388

[22] Filed: Jul. 10, 1984

[30] Foreign Application Priority Data

Jul. 13, 1983 [JP] Japan ..... 58-128268

[51] Int. Cl.[3] ..... B41M 5/18

[52] U.S. Cl. ..... 346/216; 346/217; 346/221; 346/225; 427/150; 427/151

[58] Field of Search ..... 346/216, 217, 221, 225, 346/150, 151, 152

[56] References Cited

U.S. PATENT DOCUMENTS 3,965,282 6/1976 Janssens et al. ..... 346/216
4,503,446 3/1985 Yahagi et al. ..... 346/216

FOREIGN PATENT DOCUMENTS 0031189 2/1984 Japan ..... 346/216
2109570A 6/1983 United Kingdom ..... 346/216

*Primary Examiner*—Bruce H. Hess
*Attorney, Agent, or Firm*—Armstrong, Nikaido, Marmelstein & Kubovcik

[57] ABSTRACT

This invention provides a heat-sensitive record material comprising a base sheet and a heat-sensitive record layer formed over the base sheet and containing a colorless or pale-colored basic dye and a color developing material capable of forming a color when contacted with the dye, the record material being characterized in that the heat-sensitive record layer contains as the color developing material at least one compound represented by the formula

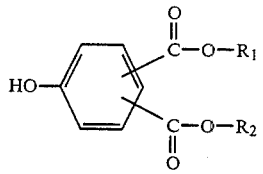

(I)

wherein $R_1$ and $R_2$ are each alkyl having 1 to 8 carbon atoms, a group

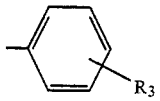

or a group

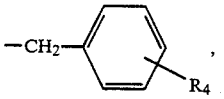

wherein $R_3$ and $R_4$ are each a hydrogen atom, chlorine atom, hydroxyl or alkoxy having 1 to 8 carbon atoms, the heat-sensitive record layer further containing at least one compound selected from the group consisting of 1,1-bis(4-hydroxyphenyl)cyclohexane and hindered phenol compounds.

10 Claims, No Drawings

HEAT-SENSITIVE RECORD MATERIAL

This invention relates to heat-sensitive record materials, and more particularly to a heat-sensitive record material suited to high-speed recording and capable of giving colorfast record images.

Heat-sensitive record materials are well known which are adapted to produce record images by thermally contacting a colorless or pale-colored electron donative chromogenic material (hereinafter referred to as a "basic dye") with an organic or inorganic color developing material.

On the other hand, heat-sensitive recording systems for producing records on such heat-sensitive record materials employ a thermal recording head which comprises, for example, an arrangement of a multiplicity of minute heat-generating resistance members. For recording, pulsating voltage is applied to required resistance members in response to image signals while feeding the heat-sensitive record material by a stepping motor for every line.

With remarkable progress in heat-sensitive recording systems in recent years, high-speed recording systems become available. For example, heat-sensitive facsimile systems produce a copy of A4 size within 20 seconds, and heat-sensitive printers achieve a recording speed of at least 120 characters/sec. Research is under way to attain still higher recording speeds.

For use with such high-speed recording systems, heat-sensitive record materials must meet various requirements such as those given below. (a) Record materials must have high recording sensitivity. Especially with the increase of recording speed, there is a tendency to apply to heat-generating resistance members of the thermal head pulses having a smaller width and lower electric energy. Although it is possible to use a high voltage to compensate for the reduction in pulse width, the life of the thermal head will then be affected adversely. In the case of heat-sensitive record materials for high-speed recording, it is required that the record layer produce a color with a high density even when low electric power is supplied to the thermal head. (b) Additionally it is required that the record material is less likely to inadvertently undergo undesired color forming reaction at low temperatures (about 60° to about 70° C.). Otherwise, when the record material is used for high-speed recording, a resistance member heated, before fully cooling off after pulse application, will produce a tailing color dot. Further when heat accumulates in the thermal head in its entirety, the record layer will form a pale color (so-called "static image") over the surface thereof. When the record material is stored in summer for a long period of time before use, the record material must be free of undesired color formation. (c) It is important that the record image obtained be colorfast. Generally, record images formed with use of basic dyes are likely to fade or disappear owing to the influence of temperature and/or humidity. Apparently such reduction of the record density is undesirable and should be avoided to the greatest possible extent. (d) It is further required that the record layer of the heat-sensitive record material as produced have a high degree of whiteness in order to produce sharp vivid record images and to give the product a high commercial value.

Heat-sensitive record materials heretofore used for recording at a relatively high speed include those having a record layer wherein stearic acid amide or like sensitizer is used in combination with a basic dye and with a phenolic compound such as 2,2-bis(4-hydroxyphenol)propane (i.e. bisphenol A). However, such heat-sensitive record materials have drawbacks; the recording sensitivity is still low, while the record images obtained are affected by temperature and/or humidity to exhibit a seriously reduced density. Moreover, stearic acid amide or like sensitizer, which is incorporated in a large amount, adheres to the thermal head as a residue and tends to produce discontinuous record images.

Also proposed are heat-sensitive record materials which have a record layer incorporating a hindered phenol in combination with a basic dye and 2,2-bis(4-hydroxyphenyl)propane or like phenolic compound, or 4-hydroxybenzoic acid, an ester thereof or like aromatic carboxylic acid derivative (Unexamined Japanese Patent Publications No. 57990/1983 and No. 87089/1983). These record materials are less susceptible to the reduction of record image density, but still remain to be improved in recording sensitivity and in initial whiteness, and are not always suited to high-speed recording.

An object of the present invention is to provide a heat-sensitive record material which is outstanding in recording sensitivity, especially in sensitivity when a low electric power is being supplied to the thermal head of the record system.

Another object of the invention is to provide a heat-sensitive record material for producing record images which are less susceptible to the density reduction due to the influence of temperature and/or humidity.

Another object of the invention is to provide a heat-sensitive record material which is free of undesired color formation at low temperatures of about 60° to about 70° C.

Still another object of the invention is to provide a heat-sensitive record material having a high degree of whiteness.

These objects and other features of the invention will become apparent from the following description.

The present invention provides a heat-sensitive record material comprising a base sheet and a heat-sensitive record layer formed over the base sheet and containing a colorless or pale-colored basic dye and a color developing material capable of forming a color when contacted with the dye, the record material being characterized in that the heat-sensitive record layer contains as the color developing material at least one compound represented by the formula

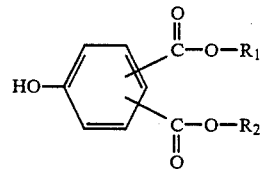

(I)

wherein $R_1$ and $R_2$ are each alkyl having 1 to 8 carbon atoms, a group

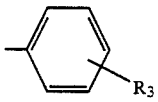

or a group

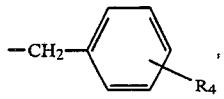

wherein $R_3$ and $R_4$ are each a hydrogen atom, chlorine atom, hydroxyl or alkoxy having 1 to 8 carbon atoms, the heat-sensitive record layer further containing at least one compound selected from the group consisting of 1,1-bis(4-hydroxy)cyclohexane and hindered phenol compounds.

I conducted extensive research on color developing materials in order to obtain heat-sensitive record materials suited to high-speed heat-sensitive recording systems and found that when the compound of the formula (I) was used as a color developing material for preparing a heat-sensitive record material, the record material had high recording sensitivity and high amenability to high-speed recording. However, when only the compound of the formula (I) was used which have so-called thermochromic properties, the density of the record image obtained was greatly reduced when the record image was affected by temperature and/or humidity. Thus, this problem remained to be overcome before using the compound of the formula (I) as a color developing material for heat-sensitive record materials. Accordingly I have further conducted continued research to develop a heat-sensitive record material incorporating the compound of the formula (I) and a colorless or pale-colored basic dye, having high recording sensitivity and giving record images without the likelihood of the density decreasing. Consequently I have found that the above object can be fulfilled when the compound of the formula (I) is used conjointly with at least one 1,1-bis(4-hydroxyphenyl)cyclohexane and hindered phenol compounds. The present invention has been accomplished based on this novel finding.

The heat-sensitive record material of the present invention has high recording sensitivity, giving record images of high density even when low power is applied to heat-generating resistance members of the thermal head. Moreover, the record images obtained are almost unlikely to have their identity reduced by temperature and/or humidity. The present record material further has the advantage of being high in the degree of whiteness and less susceptible to undesirable color formation at low temperatures. Additionally, the present record material, unlike conventional heat-sensitive record materials, does not require use of any sensitizer and is therefore usable without entailing adhesion of residue to the thermal head and the resulting problem of discontinuous record images.

Although the reason why the heat-sensitive record material of the invention has such outstanding characteristics, especially high recording sensitivity, has yet to be clarified, the remarkable characteristics appear attributable to the fact that the compound of the formula (I) has good crystallinity and a low melting point and exhibits sharp melting characteristics within the heat-sensitive record layer which contains the compound, a basic dye and a hindered phenol compound or like component.

Of the compounds represented by the formula (I), preferable are those wherein $R_1$ and $R_2$ are each alkyl having 1 to 4 carbon atoms, phenyl or benzyl. Typical examples of compounds represented by the formula (I) are as follows.

| | | |
|---|---|---|
| Dimethyl 4-hydroxyphthalate | m.p. | 110° C. |
| Diethyl 4-hydroxyphthalate | m.p. | 65° C. |
| Di-isopropyl 4-hydroxyphthalate | m.p. | 103–105° C. |
| Dibenzyl 4-hydroxyphthalate | m.p. | 87–90° C. |
| Dimethyl 4-hydroxyisophthalate | m.p. | 98° C. |
| Dimethyl 2-hydroxyisophthalate | m.p. | 72° C. |
| Diethyl 2-hydroxyisophthalate | m.p. | 112° C. |
| Diphenyl 2-hydroxyisophthalate | m.p. | 99° C. |
| Diethyl 5-hydroxyisophthalate | m.p. | 103° C. |
| Dimethyl hydroxyterephthalate | m.p. | 94° C. |

At least two of these compounds are of course usable in combination.

Of the hindered phenol compounds useful for the present invention, preferable are phenols having an alkyl substituent at least at one of the 2- and 6-positions (i.e., two ortho-positions relative to the hydroxyl) and derivatives thereof. Of these, more preferable are phenols substituted with tert-butyl at least at one of the 2-position and 6-position, and derivatives thereof. Also preferable are hindered phenol compounds having a plurality of phenol groups, especially two or three phenol groups, in the molecule. Examples of such compounds are given below.

1,1,3-Tris(2-methyl-4-hydroxy-5-tert-butylphenyl)butane
4,4'-Thiobis(3-methyl-6-tert-butylphenol)
4,4'-Thiobis(2-methyl-6-tert-butylphenol)
2,2'-Thiobis(4-methyl-6-tert-butylphenol)
2,2'-Methylenebis(4-methyl-6-tert-butylphenol)
2,2'-Methylenebis(4-ethyl-6-tert-butylphenol)
4,4'-Butylidenebis(3-methyl-6-tert-butylphenol)
4,4'-Methylenebis(2,6-di-tert-butylphenol)

The thermochromic properties of the compound of the formula (I) are eliminated when the compound of the formula (I) is used conjointly with 1,1-bis(4-hydroxyphenol)cyclohexane or the hindered phenol compound. Although the reason therefore has not been clarified, the compound of the formula (I), melted and reacted for color formation by heating, will be prevented from recrystallization by the conjoint use of such compounds despite a reduction of temperature to produce the above effect.

Of the foregoing 1,1'-bis(4-hydroxyphenol)cyclohexane and the hindered phenol compounds, 1,1,3-tris(2-methyl-4-hydroxy-5-tert-butylphenol)butane is most preferable, since the use of this compound gives a heat-sensitive record material which is even less susceptible to the reduction of record image density, and which is even more excellent due to its whiteness and absence of undesired color formation at low temperatures.

Examples of colorless or pale-colored basic dyes which can be used to form the record layer for the present heat-sensitive record materials include those heretofore known as given below:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-cyclohexy-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, etc.

The basic dyes in the present invention are not limited to those exemplified above, and at least two of these dyes can be used in admixture.

Of these dyes, fluoran-based dyes represented by the formula

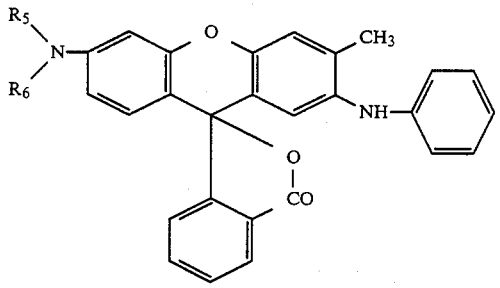

(II)

wherein $R_5$ is alkyl having 1 to 4 carbon atoms and $R_6$ is alkyl having 1 to 6 carbon atoms or cyclohexyl are very useful in the production of record materials markedly suitable for high-speed recording because these dyes are outstanding in compatibility with the compounds of the formula (I) used in the present invention. Of the fluoran-based dyes of the formula (II), those disclosed in Examined Japanese Patent Publication No. 52759/1981, e.g., 3-(N-methyl-N-n-amyl)amino-6-methyl-7-phenylaminofluoran, 3-(N-ethyl-N-n-amyl)amino-6-methyl-7-phenylaminofluoran, 3-(N-ethyl-N-isoamyl-)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, etc. are excellent in giving both whiteness and recording sensitivity and can exhibit even more improved characteristics when used conjointly with the compound of the formula (I). Accordingly it is particularly preferred to use the dyes in the present invention.

The compound of the formula (I) to be incorporated into the record layer in the present invention is used in an amount of about 1 to about 50 parts by weight, preferably about 2 to about 10 parts by weight, per part by weight of the basic dye.

At least one of the 1,1-bis(4-hydroxyphenyl)cyclohexane and hindered phenol compounds is used in an amount of usually about 1 to about 1000 parts by weight, preferably about 10 to about 300 parts by weight, per 100 parts by weight of the compound of the formula (I).

These materials are formulated into a coating composition for heat-sensitive record layer generally with use of water as a dispersion medium and a stirring or pulverizing device, such as a ball mill, attritor or sand mill, by dispersing these materials at the same time or separately. Usually the coating composition has incorporated therein a binder, such as starches, hydroxyethyl cellulose, methyl cellulose, carboxymethyl cellulose, gelation, casein, gum arabic, polyvinyl alcohol, styrene-maleic anhydride copolymer salt, styrene-acrylic acid copolymer salt, styrene-butadiene copolymer emulsion or the like. The binder is used in an amount of about 5 to about 40% by weight, preferably about 10 to about 30% by weight, based on the total solids content of the composition.

Various auxiliary agents can be further admixed with the coating composition. Examples of useful auxiliary agents are dispersants such as sodium dioctylsulfosuccinate, sodium dodecylbenzenesulfonate, sodium lauryl sulfate and fatty acid metallic salts; ultraviolet absorbers of the benzophenone, triazole or like type; defoaming agents, fluorescent dyes; coloring dyes, etc. A dispersion or emulsion of stearic acid, polyethylene, carnauba wax, paraffin wax, zinc stearate, calcium stearate, ester wax or the like can be incorporated into the coating composition in order to prevent the heat-sensitive record material from sticking to the recording machine or thermal recording head on its contact therewith. An inorganic pigment such as kaolin, clay, talc, calcium carbonate, calcined clay, titanium oxide, diatomaceous earth, fine granular anhydrous silica, activated clay or the like can be added to the coating composition in order to eliminate or reduce the tendency of the residue to be piled on the thermal recording head. When required, an agent for improving the recording sensitivity can be admixed with the coating composition, although usually such agent is not incorporated therein. Examples of such agent useful in the present invention are stearic acid amide, stearic acid methylenebisamide, oleic acid amide, palmitic acid amide, sperm oleic acid amide, coconut fatty acid amide, etc.

A phenol compound or like color developing material which is conventionally used in the art can also be used in the invention so far as its use does not adversely affect the advantages of the invention.

According to the present invention, useful base sheets include paper, plastic film, synthetic fiber sheet and the like among which paper is most preferred in terms of the costs, ease for coating, etc. The amount of the coating composition which is applied to the base sheet to form a record layer thereon is not particularly limited, but is generally about 2 to about 12 g/m$^2$, preferably about 3 to about 10 g/m$^2$, based on the dry weight. An overcoat can be applied over the record layer to protect the record layer. Further an undercoat can be formed, of course, between the base sheet and the record layer. In practicing the present invention, it is possible to use various techniques heretofore known in the field of manufacture of heat-sensitive record materials.

The heat-sensitive record materials thus obtained according to the present invention are suitable for high-speed recording, have high whiteness and have improved properties including those of preventing the image from fading away and involving a less amount of residue piled on the thermal recording head.

The present invention will be described below in more detail with reference to the following Examples to which the present invention, of course, is not limited. In the Examples, the parts and the percentages are all by weight unless otherwise specified.

EXAMPLE 1

(1) Preparation of mixture A
3-(N-Cyclohexyl-N-methylamino)-6-methyl-7-phenylaminofluoran: 10 parts
Methyl cellulose, 5% aqueous solution: 5 parts
Water: 40 parts
The above mixture was pulverized by a sand mill to a mean particle size of 3 μm.

(2) Preparation of mixture B
Dimethyl 4-hydroxyphthalate: 20 parts
Methyl cellulose, 5% aqueous solution: 5 parts
Water: 55 parts
The above mixture was pulverized by a sand mill to a mean particle size of 3 μm.

(3) Preparation of mixture C
1,1,3-Tris(2-methyl-4-hydroxy-5-tert-butylphenyl)-butane: 20 parts
Methyl cellulose, 5% aqueous solution: 5 parts
Water: 55 parts
The above mixture was pulverized by a sand mill to a mean particle size of 3 μm.

(4) Formation of record layer
Fifty-five parts of the mixture A, 80 parts of the mixture B, 80 parts of the mixture C, 15 parts of fine granular anhydrous silica (oil absorption 180 ml/100 g), 50 parts of a 20% aqueous solution of oxidized starch and 10 parts of water were mixed together and agitated to obtain a coating composition for heat-sensitive record layer. The composition was applied to non-coated paper weighing 50 g/m$^2$ in an amount of 7 g/m$^2$ based on dry weight, and dried to obtain a heat-sensitive record material.

EXAMPLES 2 TO 8

Seven kinds of heat-sensitive record materials were prepared in the same manner as in Example 1 with the exception of using the following color developing materials in place of the dimethyl 4-hydroxyphthalate employed in preparing the mixture B.

| Example | Color Developing Material |
|---|---|
| 2 | Di-isopropyl 4-hydroxyphthalate |
| 3 | Dibenzyl 4-hydroxyphthalate |
| 4 | Diethyl 2-hydroxyisophthalate |
| 5 | Diphenyl 2-hydroxyisophthalate |
| 6 | Dimethyl 4-hydroxyisophthalate |
| 7 | Diethyl 5-hydroxyisophthalate |
| 8 | Dimethyl hydroxyterephthalate |

EXAMPLES 9 TO 11

Three kinds of heat-sensitive record materials were prepared in the same manner as in Example 1 with the exception of using the following hindered phenol compounds in place of the 1,1,3-tris(2-methyl-4-hydroxy-5-tert-butylphenyl)butane employed in preparing the mixture C.

| Example | Hindered Phenol Compound |
|---|---|
| 9 | 4,4'-Butylidenebis(3-methyl-6-tert-butylphenol) |
| 10 | 2,2'-Methylenebis(4-methyl-6-tert-butylphenol) |
| 11 | 4,4'-Thiobis(3-methyl-6-tert-butylphenol) |

EXAMPLE 12

A heat-sensitive record material was prepared in the same manner as in Example 1 with the exception of using 3-(N-ethyl-N-isoamyl)amino-6-methyl-7-phenylaminofluoran in place of the 3-(N-cyclohexyl-N-methylamino)-6-methyl-7-phenylaminofluoran in preparing the mixture A.

EXAMPLE 13

A heat-sensitive record material was prepared in the same manner as in Example 1 with the exception of using 3-(N-ethyl-N-isoamyl)amino-6-methyl-7-phenylaminofluoran in place of the 3-(N-cyclohexyl-N-methylamino)-6-methyl-7-phenylaminofluoran in preparing the mixture A, and 1,1-bis(4-hydroxyphenyl)cyclohexane in place of the 1,1,3-tris(2-methyl-4-hydroxy-5-tert-butylphenyl)butane employed in preparing the mixture C.

EXAMPLE 14

A heat-sensitive record material was prepared in the same manner as in Example 1 with the exception of using 10 parts of each of 3-(N-cyclohexyl-N-methylamino)-6-methyl-7-phenylaminofluoran and 3-(N-ethyl-N-isoamyl)amino-6-methyl-7-phenylaminofluoran in place of 20 parts of the 3-(N-cyclohexyl-N-methylamino)-6-methyl-7-phenylaminofluoran employed in preparing the mixture A.

COMPARISON EXAMPLE 1

(1) Preparation of mixture A
3-(N-Cyclohexyl-N-methylamino)-6-methyl-7-phenylaminofluoran: 10 parts
Methyl cellulose, 5% aqueous solution: 5 parts
Water: 40 parts
The above mixture was pulverized by a sand mill to a mean particle size of 3 μm.

(2) Preparation of mixture B
Dimethyl 4-hydroxyphthalate: 20 parts
Methyl cellulose, 5% aqueous solution: 5 parts Water: 55 parts The above mixture was pulverized by a sand mill to a mean particle size of 3 μm.

(3) Formation of record layer

Fifty-five parts of the mixture A, 80 parts of the mixture B, 15 parts of fine granular anhydrous silica (oil absorption 180 ml/100 g), 50 parts of a 20% aqueous solution of oxidized starch and 20 parts of water were mixed together and agitated to obtain a coating composition. The composition was applied to non-coated paper weighing 50 g/m$^2$ in an amount of 7 g/m$^2$ based on dry weight, and dried to obtain a heat-sensitive record material.

COMPARISON EXAMPLE 2

A heat-sensitive record material was prepared in the same manner as in Comparison Example 1 with the exception of using dimethyl 4-hydroxyisophthalate in place of the dimethyl 4-hydroxyphthalate employed in preparing the mixture B.

COMPARISON EXAMPLE 3

A heat-sensitive record material was prepared in the same manner as in Example 1 with the exception of using benzyl 4-hydroxybenzoate in place of the dimethyl 4-hydroxyphthalate employed in the preparing the mixture B.

COMPARISON EXAMPLE 4

A heat-sensitive record material was produced in the same manner as in Example 1 with the exception of using 3-(N-ethyl-N-isoamyl)amino-6-methyl-7-phenylaminofluoran in place of the 3-(N-cyclohexyl-N-methylamino)-6-methyl-7-phenylaminofluoran employed in preparing the mixture A, benzyl 4-hydroxybenzoate in place of the dimethyl 4-hydroxyphthalate employed in preparing the mixture B, and 1,1-bis(4-hydroxyphenyl)cyclohexane in place of the 1,1,3-tris(2-methyl-4-hydroxy-5-tert-butylphenyl)butane employed in preparing the mixture C.

COMPARISON EXAMPLE 5

A heat-sensitive record material was produced in the same manner as in Example 1 with the exception of using 2,2-bis(4-hydroxyphenyl)propane in place of the dimethyl 4-hydroxyphthalate employed in preparing the mixture B and stearic acid amide in place of the 1,1,3-tris(2-methyl-4-hydroxy-5-tert-butylphenyl)butane employed in preparing the mixture C.

The 19 kinds of heat-sensitive record materials thus obtained were checked for properties as follows.

(i) Whiteness

The whiteness of the record layer of the heat-sensitive record materials was determined by a Hunter multipurpose reflectometer according to JIS P8123 with the results as shown in Table 1 below.

(ii) Image density at low power

Each of the heat-sensitive record materials was caused to form images thereon with use of a heat-sensitive facsimile tester equipped with a thermal recording head (KRT-256-8 IIIA, product of Kyocera Corporation, Japan) operated at a low electric power of 0.5 W/dot, and the image density of each record material was measured by a Macbeth reflection densitometer (Model RD-100R, product of Macbeth Corp., U.S.A. with use of amber filter). Table 1 below shows the results.

(iii) Image density ($D_1$)

Each of the heat-sensitive record materials was caused to form images thereon with use of a heat-sensitive facsimile (model HIFAX-700, product of Hitachi, Ltd., Japan) and the resulting image density ($D_1$) was determined by the same type of a Macbeth reflection densitometer as used above in (ii) with the results as shown in Table 1 below.

(iv) Image density ($D_2$)

The record materials with the images formed in (iii) were left to stand in an atmosphere maintained at 40° C. and 90% RH for 24 hours, and then the image density ($D_2$) was determined again by the same type of Macbeth reflection densitometer. Image density retentivity (%) which is given by $(D_2/D_1)\times 100$ was calculated and shown in Table 1 below.

TABLE 1

| | Whiteness (%) | Image density (low power) | Image density ($D_1$) | Image density ($D_2$) (after temperature humidity resistance test) | Image density retentivity (%) |
|---|---|---|---|---|---|
| Ex. | | | | | |
| 1 | 83 | 0.94 | 1.03 | 1.01 | 98 |
| 2 | 83 | 0.95 | 1.05 | 1.01 | 96 |
| 3 | 80 | 0.97 | 1.09 | 1.00 | 92 |
| 4 | 83 | 0.92 | 1.00 | 0.98 | 98 |
| 5 | 82 | 0.95 | 1.03 | 0.97 | 94 |
| 6 | 81 | 0.96 | 1.06 | 0.98 | 93 |
| 7 | 82 | 0.95 | 1.04 | 1.01 | 97 |
| 8 | 80 | 0.96 | 1.07 | 1.02 | 95 |
| 9 | 83 | 0.94 | 1.03 | 0.77 | 75 |
| 10 | 82 | 0.96 | 1.04 | 0.75 | 72 |
| 11 | 80 | 0.95 | 1.04 | 0.87 | 84 |
| 12 | 85 | 0.98 | 1.11 | 1.08 | 97 |
| 13 | 79 | 0.96 | 1.05 | 0.96 | 91 |
| 14 | 83 | 0.99 | 1.09 | 1.06 | 97 |
| Comp. Ex. | | | | | |
| 1 | 83 | 0.85 | 0.93 | 0.28 | 30 |
| 2 | 81 | 0.86 | 0.95 | 0.24 | 25 |
| 3 | 76 | 0.72 | 0.88 | 0.83 | 94 |
| 4 | 74 | 0.75 | 0.91 | 0.85 | 93 |
| 5 | 73 | 0.49 | 0.75 | 0.38 | 51 |

In Table 1, the values of whiteness indicate that the greater the value, the whiter the record layer, and those of image density show that the greater the value, the higher the image density.

Table 1 reveals that the heat-sensitive record materials of the present invention have a high whiteness and an excellent recording sensitivity particularly even when recorded at a low electric power and involve little or no reduction in the image density of the color formed thereon.

I claim:

1. A heat-sensitive record material comprising a base sheet and a heat-sensitive record layer formed over the base sheet and containing a colorless or pale-colored basic dye and a color developing material capable of forming a color when contacted with the dye, the record material being characterized in that the heat-sensitive record layer contains as the color developing material at least one compound represented by the formula

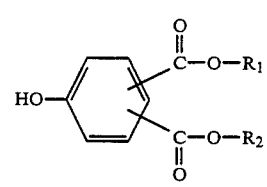

(I)

wherein $R_1$ and $R_2$ are each alkyl having 1 to 8 carbon atoms, a group

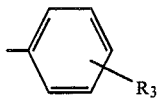

or a group

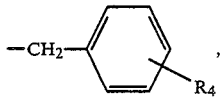

wherein $R_3$ and $R_4$ are each a hydrogen atom, chlorine atom, hydroxyl or alkoxy having 1 to 8 carbon atoms, the heat-sensitive record layer further containing at least one compound selected from the group consisting of 1,1-bis(4-hydroxyphenyl)cyclohexane and hindered phenol compounds.

2. A heat-sensitive record material as defined in claim 1 wherein $R_1$ and $R_2$ in the compound of the formula (I) are alkyl having 1 to 4 carbon atoms, phenyl or benzyl.

3. A heat-sensitive record material as defined in claim 2 wherein the compound of the formula (I) is dimethyl 4-hydroxyphthalate, diethyl 4-hydroxyphthalate, di-isopropyl 4-hydroxyphthalate, dibenzyl 4-hydroxyphthalate, dimethyl 4-hydroxyisophthalate, dimethyl 2-hydroxyisophthalate, diethyl 2-hydroxyisophthalate, diphenyl 2-hydroxyisophthalate, diethyl 5-hydroxyisophthalate, or dimethyl hydroxyterephthalate.

4. A heat-sensitive record material as defined in claim 1 wherein the hindered phenol compounds are phenols substituted with alkyl at least at one of the 2- and 6-positions or their derivatives having 2 or 3 phenol groups.

5. A heat-sensitive record material as defined in claim 1 wherein the hindered phenol compound is at least one species selected from the group consisting of 1,1,3-tris(2-methyl-4-hydroxy-5-tert-butylphenyl)butane, 4,4'-thiobis(3-methyl-6-tert-butylphenol), 4,4'-thiobis(2-methyl-6-tert-butylphenol), 2,2'-thiobis(4-methyl-6-tert-butylphenol), 2,2'-methylenebis(4-methyl-6-tert-butylphenol), 2,2'-methylenebis(4-ethyl-6-tert-butylphenol), 4,4'-butylidenebis(3-methyl-6-tert-butylphenol) and 4,4'-methylenebis(2,6-di-tert-butylphenol).

6. A heat-sensitive record material as defined in claim 1 wherein the basic dye is at least one of the dyes represented by the formula

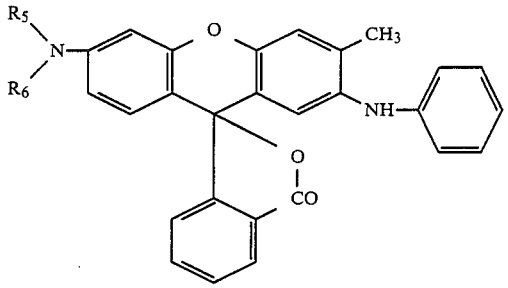

(II)

wherein $R_5$ is alkyl having 1 to 4 carbon atoms and $R_6$ is alkyl having 1 to 6 carbon atoms or cyclohexyl.

7. A heat-sensitive record material as defined in claim 1 wherein the compound of the formula (I) is used in an amount of about 1 to about 50 parts by weight per part by weight of the basic dye.

8. A heat-sensitive record material as defined in claim 1 wherein the compound (I) is used in an amount of about 2 to about 10 parts by weight per part by weight of the basic dye.

9. A heat-sensitive record material as defined in claim 1 wherein 1,1-bis(4-hydroxyphenyl)cyclohexane or the hindered phenol compound is used in an amount of about 1 to about 1000 parts by weight per 100 parts by weight of the compound of the formula (I).

10. A heat-sensitive record material as defined in claim 1 wherein 1,1-bis(4-hydroxyphenyl)cyclohexane or the hindered phenol compound is used in an amount of about 10 to about 300 parts by weight per 100 parts by weight of the compound of the formula (I).

* * * * *